US005273086A

United States Patent [19]

Estibal

[11] Patent Number: 5,273,086

[45] Date of Patent: Dec. 28, 1993

[54] CLOSED CUP PROVIDED WITH A LIP CAPABLE OF BEING TAKEN IN THE MOUTH BY A USER AND COMBINED CUPBOARD FOR ITS HANDLING

[76] Inventor: Corinne Estibal, 12, Esplanade Compans-Caffarelli, 31000 Toulouse, France

[21] Appl. No.: 869,005

[22] Filed: Apr. 16, 1992

[30] Foreign Application Priority Data

Apr. 17, 1991 [FR] France ..... 91 04709
Apr. 17, 1991 [FR] France ..... 91 04708

[51] Int. Cl.[5] ..... A47G 19/22; B65B 3/00

[52] U.S. Cl. ..... 141/89; 141/91; 141/23; 141/114; 141/348; 141/DIG. 1; 220/8; 220/705; 220/714; 220/720; 220/724; 220/666; 222/106; 215/11.4

[58] Field of Search ..... 141/2, 5, 6, 23-26, 141/114, 237, 246, 313, 348, 349, 369, 386, DIG. 1, 165, 325, 337, 89-92; 222/92, 96, 106; 224/30 A, 30 R, 148; 128/202.15; 215/11.3, 11.4; 220/8, 220, 705, 711, 713, 714, 717, 720, 721, 724, 666, 907; 312/1, 43, 115, 209, 228, 229

[56] References Cited

U.S. PATENT DOCUMENTS

| | | | |
|---|---|---|---|
| 3,114,468 | 12/1963 | Quase | 220/8 |
| 3,143,429 | 8/1964 | Swanson et al. | 215/11.3 |
| 4,445,539 | 5/1984 | Credle | 137/614.03 |
| 4,629,589 | 12/1986 | Gupta et al. | 261/34.1 |
| 4,657,151 | 4/1987 | Cabernoch | 215/11.4 |
| 4,875,508 | 10/1989 | Burke, II et al. | 141/2 |
| 4,994,076 | 2/1991 | Guss | 215/11.4 |
| 5,078,287 | 1/1992 | Holmes, III | 220/8 |
| 5,158,218 | 10/1992 | Wery | 224/30 |

FOREIGN PATENT DOCUMENTS

| | | |
|---|---|---|
| 0326743 | 8/1989 | European Pat. Off. . |
| 2024656 | 8/1970 | France . |
| 8706457 | 11/1987 | PCT Int'l Appl. . |

*Primary Examiner*—Ernest G. Cusick
*Attorney, Agent, or Firm*—Cushman, Darby & Cushman

[57] ABSTRACT

A cup is provided with a flexible lip containing a duct having an end provided with a flexible valve which is opened by pinching the lip; the duct communicates with a receptacle containing the beverage and the wall of the receptacle is made from a flexible material so as to expand when a liquid is injected into the receptacle and to exert on the liquid a pressure tending to expel the liquid from the receptacle; a cover is provided for storing the cup and includes a filling and washing area.

21 Claims, 3 Drawing Sheets

CLOSED CUP PROVIDED WITH A LIP CAPABLE OF BEING TAKEN IN THE MOUTH BY A USER AND COMBINED CUPBOARD FOR ITS HANDLING

This invention relates to a cup which remains closed when not used by a user and which allows the user to drink the liquid or the beverage contained in said cup by taking the lip in his mouth, without having to suck the liquid. The invention also relates to a cupboard for handling such a cup.

The cup according to the invention may contain a beverage prepared in advance or allows to prepare a beverage on spot. It may be used in the state of gravity, on earth, but it is particularly adapted for use in the state of absence of gravity, more particularly, for the preparation of a beverage on board a spacecraft.

DESCRIPTION OF THE PRIOR ART

It is indeed known that it is difficult to prepare a beverage on board a spacecraft for, in the state of absence of gravity, when a receptacle is filled with a liquid, the air contained in the receptacle is not expelled and mixes up with the beverage. This results into a foam which is distasteful and which is not easily digestible. In addition, the spationaut had no pleasure in preparing the beverage.

Furthermore, in the absence of gravity, the earth attraction force cannot be used to direct a liquid. Hence, there should be created a force allowing to impart to the liquid the desired motion to fill the receptacle and to drink the liquid. Until now, the spationaut most frequently sucked the liquid through a pipe. If the liquid was contained in a receptacle made of a flexible material, he could also press the receptacle with his both hands to have the liquid come out.

This invention provides a cup which, in the state of absence of gravity, allows drinking without having to suck or to exert a force onto the receptacle containing the liquid and which allows to prepare the beverages on spot without forming foam. In the state of gravity, on earth, the closed cup according to the invention allows to drink without risk of spilling liquid and without having to suck the beverage, which is advantageous, for instance, in the case of sick people confined to bed.

Thus, the object of this invention is a closed cup provided with a lip capable of being taken in the mouth by a user, containing a duct, this duct communicating with a receptacle containing the beverage, the wall of which has, because of its constituent material and/or its structural arrangement, a flexibility such as to expand when a liquid is injected into the receptacle and to exert onto said liquid a pressure having a tendency to expel same from the receptacle, characterized in that said lip is flexible and that the duct is provided, at the level of its end, with a flexible valve opening by pinching the lip.

The flexible valve located at the end of the lip is preferably comprised of two coaxial flexible pipes, the inner pipe being closed at one end and including, in the vicinity of this end, a slit the plane of which is oblique to the axis of said pipe.

The receptacle preferably has an accordion-pleated structure. The receptacle advantageously has a shape the cross-section diameter of which, for instance, decreases in the shape of a truncated cone. In this way, when the accordion-pleated structure is folded (before expansion), the receptacle is almost flat.

The flexible lip is preferably a part of a mouthpiece including a rigid base.

According to the invention, the flexible receptacle can be non-removably secured to the mouthpiece or be part of a refill which is secured onto the mouthpiece at the moment of using same.

Consequently, in this latter embodiment, the closed cup according to the invention is comprised of two parts, i.e. a mouthpiece and a refill; preferably:

- the mouthpiece is a closed enclosure including a rigid base provided with a device for being seized by the user, a first means for the passage of the liquid from the refill into the mouthpiece and a first member for securing the refill onto the mouthpiece, the flexible lip being integral with the base, and
- the refill is a closed enclosure including a rigid cover provided with a second means for the passage of the liquid from the refill into the mouthpiece, which second means is complementary to the first means for the passage of the liquid borne by the mouthpiece, and with a second member for securing the refill onto the mouthpiece which is complementary to the first securing member, the cover closing the receptacle and bearing a non-return valve for the feeding of liquid into said receptacle.

The use of the cup according to the invention including a refill is simple. When the user, more particularly the spationaut, wants to drink, he takes an empty refill or a refill containing, in the form of powder, for instance lyophilized powder, the beverage he wants (such as coffee, tea, chocolate or fruit juice); he connects the refill onto the mouthpiece and assembles them so that the communication be established between the mouthpiece and the refill; then, he introduces into the receptacle a determined quantity of hot or cold water, through the water-feeding valve. The receptacle increases in volume. To drink, the spationaut seizes the cup by the seizing device; he takes the lip of the mouthpiece in his mouth and pinches same with his lips or his teeth, which, by distortion, opens the flexible valve arranged at the end of the lip. The liquid then comes out of the cup, thanks to the pressure elastically exerted by the walls of the receptable, without the user having to suck the liquid or to press the receptacle with his hands to have the liquid come out. Thus, the spationaut can drink a beverage prepared on board, by making almost the same movements as on earth. When he finishes drinking, the spationaut separates the mouthpiece from the refill, throws the refill away and subjects the mouthpiece to a washing.

The base preferably consists of a rigid part comprised of two equal half-discs located in two parallel planes spaced apart from each other, both half-discs being connected to each other, in the first place, by a wall located alongside the diameters which limit them in a plane perpendicular to their plane and, in the second place, by a shell connected to the periphery of both half-discs which form the base of same, the edge of the shell forming a tip on the side of the lip, the seizing device being arranged on said shell.

The seizing device is preferably arranged on either side of the shell with respect to the plane of the wall.

The lip made of a flexible material preferably includes a tip bent towards the axis of the cup and partly connected to the edge of the shell by means of a concavely shaped film made of a flexible material, the shell having about the shape of a portion of a sphere.

A duct made of a flexible material preferably connects the flexible valve of the lip to a first means for the passage of the liquid from the refill into the mouthpiece.

The rigid cover of the refill preferably includes two equal parallel half-discs connected to each other, in the first place, alongside diameters which limit them, by a wall which is perpendicular to same and, in the second place, by a cylindrical skirt which is connected to the periphery of both half-discs. In this embodiment, the receptacle is advantageously secured to the skirt.

The means for the passage of the liquid consist, for the first means, of a small pipe arranged perpendicularly to one perpendicular wall and passing across said wall and, for the second means, of an opening made in the other perpendicular wall, both means cooperating in a substantially leak-proof way.

According to a preferred embodiment, in the mouthpiece, between the first passage means and the flexible duct connecting same to the flexible valve of the lip, is arranged a non-return valve which allows the liquid to pass only in the direction of the lip. The presence of this non-return valve allows to avoid the liquid contained in the mouthpiece from spilling when the user separates the mouthpiece from the refill before having completely emptied the cup. Similarly, in the refill the second passage means is associated with a non-return valve which is opened and kept open by the co-operation with the first passage means. For instance, when the first passage means is a small pipe and the complementary means an opening, the end of the small pipe opens and keeps open the non-return valve. The liquid contained in the refill is thus prevented from spilling when the user separates the refill from the mouthpiece. For instance, when the small pipe is removed from the opening, the non-return valve indeed closes and the liquid contained in the refill is thus prevented from spilling when the user has not emptied said refill.

The securing of the refill onto the mouthpiece occurs, as explained above, by means of two complementary members arranged one on the base, the other one on the cover. The fixing means may consist of a groove-rim system. This fixing means also serves as a guiding when assembling the cup.

This invention also relates to a combined cupboard allowing to carry out various operations of handling such a cup. In this respect, it provides a cupboard which occupies a small volume and allows to carry out all operations of storing the refills, filling the cup, washing the mouthpiece and storing the mouthpiece.

The use of this cup indeed requires a number of operations. When the user wants to drink, he selects a refill. Thus, this must be readily accessibly stored. Then, he takes a mouthpiece which should also be readily accessible. Afterwards, he connects the mouthpiece to the refill and fills the cups. It is therefore necessary to have a cupfilling installation. When the user finishes drinking, he separates the mouthpiece from the refill. The mouthpiece must then be washed and stored, after washing, to be able to be used again. This use viz. occurs in a state of absence of gravity on board a spacecraft.

Thus, also an object of this invention is a combined cupboard allowing to carry out the various handlings of a cup comprised of two parts capable of being assembled to each other by putting into contact two complementary rigid surfaces, i.e. a mouthpiece and a refill, the mouthpiece being a closed enclosure including a rigid base provided with a first means for the passage of the liquid from the refill into the mouthpiece and the refill being a closed enclosure including a rigid cover bearing a non-return valve for the feeding of liquid into the refill and, secured onto the cover, a receptacle expandable under the pressure of the liquid injected, characterized in that it includes at least two areas, i.e.:

a filling area including at least one water tank, at least one cup-filling track and a device capable of co-operating with the non-return valve for the feeding of liquid into the refill; and a washing area for at least one mouthpiece, including means for washing the inside of the mouthpiece and means for washing the outside of the mouthpiece.

The cupboard preferably includes an area including superposed trays for storing the refills. It advantageously also includes a storage area for at least one mouthpiece.

Preferably, the filling area includes two tanks and two tracks, a first tank being provided for cold water and communicating with a first track and a second tank being provided for hot water and corresponding to a second track.

The track advantageously has a partial egg-shape corresponding to the shape of the cup upon expansion of the receptacle.

The device capable of co-operating in a leak-proof way with the non-return valve for the feeding of water into the refill advantageously consists of a pipe provided with a protection ring and connected to a non-return valve, the downward pressure onto the protection ring causing the non-return valve to open.

According to a preferred embodiment, the filling area includes a device for metering the quantity of liquid supplied, allowing to supply a determined quantity of liquid. This device allows, for instance, to introduce 10 cl or 20 cl of liquid into the receptacle. It is preferably associated with a signal lamp which warns the user of the end of the supply.

In these circumstances, the front panel of the filling area advantageously has four buttons which the user presses to obtain, for instance, 10 cl or 20 cl of cold or hot water.

The washing area preferably includes at least one stand having a shape complementary to that of the surface of the rigid base of the mouthpiece and a device capable of co-operating with the means for the passage of the liquid into the mouthpiece, to inject a washing liquid into the mouthpiece and to suck in same, so as to wash the inside of the mouthpiece.

The stand complementary to the assembling surface of the rigid base of the mouthpiece is advantageously provided with a magnet or metal part which co-operates with a corresponding magnet arranged on the rigid surface of the mouthpiece, so as to fix the mouthpiece onto the stand.

This washing area is preferably capable of being tightly closed by a door, in order to be able to wash the outer surface of the mouthpiece as in a common dishwasher.

The mouthpiece-storage area preferably includes at least one tray the bottom of which has a shape complementary to that of the assembling surface of the rigid base of the mouthpiece.

For a better understanding of the object of the invention, an embodiment shown in the attached drawing will now be described by way of an illustrative and non-exhaustive example.

DETAILED DESCRIPTION OF THE INVENTION

Figure 1:
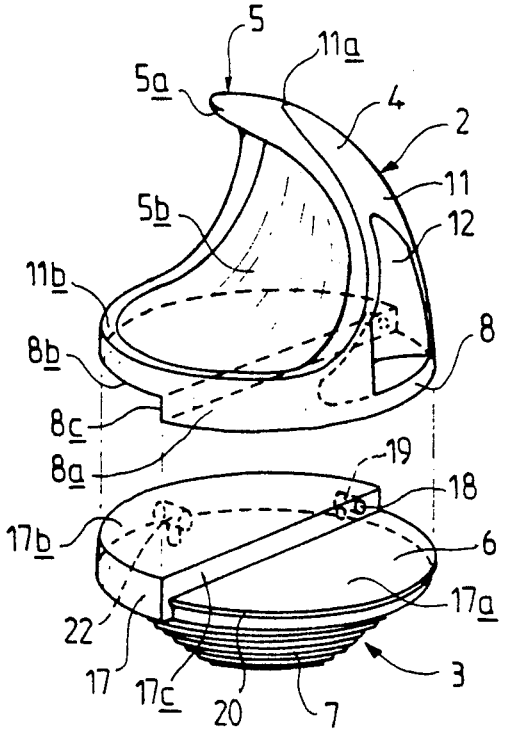
FIG. 1 is a perspective view of a cup according to the invention, during assembling.
Figure 2:
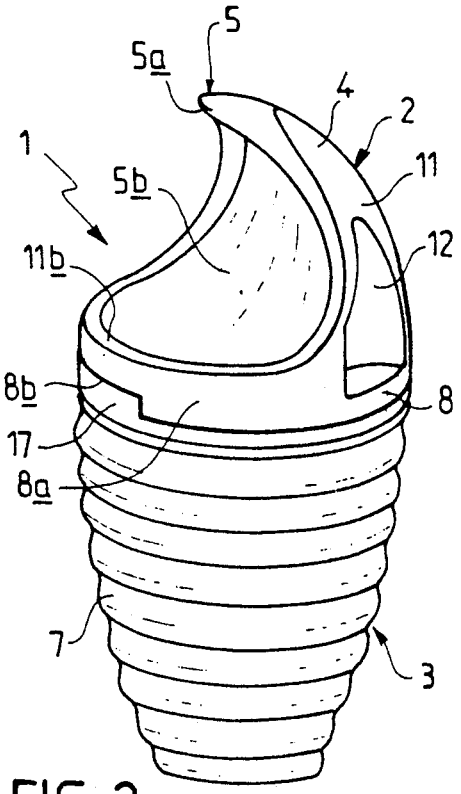
FIG. 2 is a perspective view of the same cup, after assembling and water injection.
Figure 3:
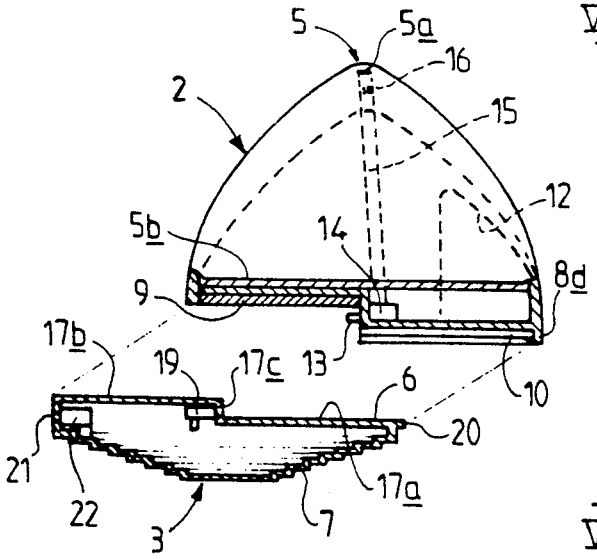
FIG. 3 is a cross-sectional view of the cup, during assembling.
Figure 4:
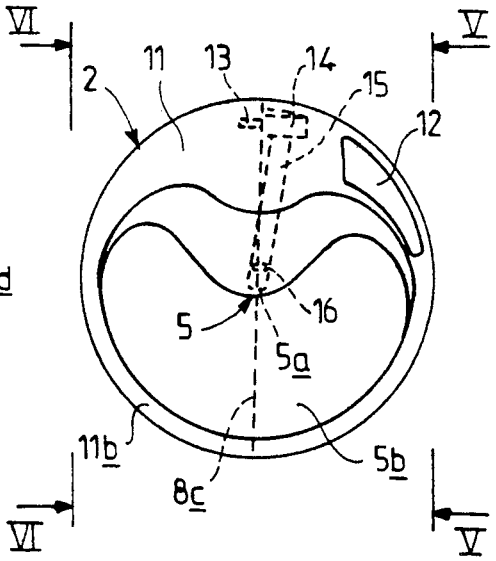
FIG. 4 is a top view of the cup of FIG. 1.
Figure 5:
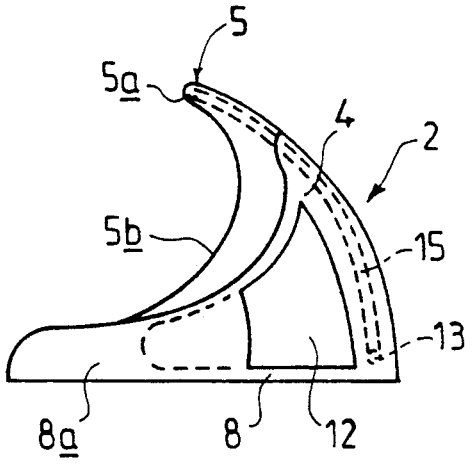
FIGS. 5 and 6 are views (right and left, respectively) in profile of the mouthpiece of the cup according to the invention.
Figure 6:
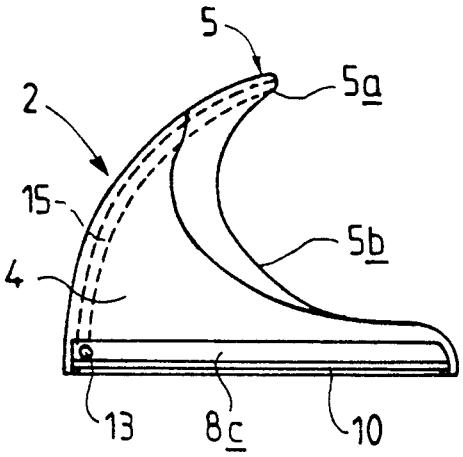
Figure 7:
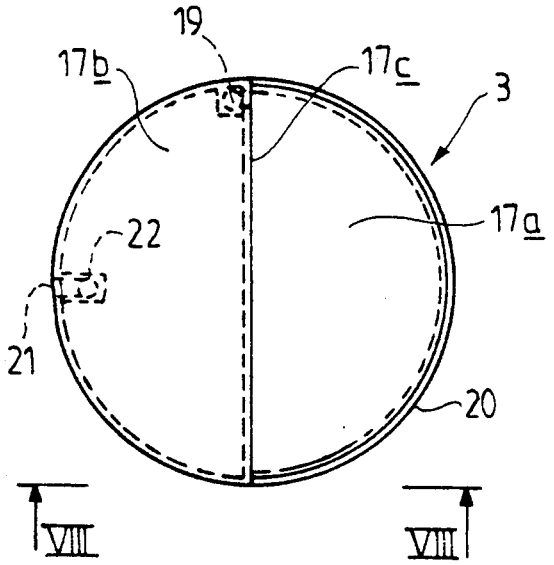
FIG. 7 is a top view of the refill receptacle according to VII—VII of FIG. 8.
Figure 8:
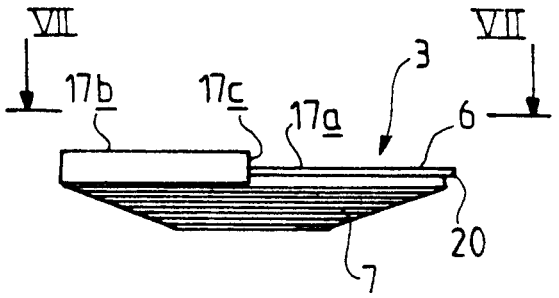
FIG. 8 is a side view of this same refill receptacle according to VIII—VIII of FIG. 7.

The cup shown in FIGS. 1 to 8 is designated, in its whole, by reference numeral 1. It is comprised of a mouthpiece 2 and a refillable receptacle, called a refill 3. The mouthpiece 2 is comprised of a rigid base 4 and a lip 5 made of a flexible material and the refill 3 is formed of a rigid cover 6 and a receptacle 7 made of a flexible material and having an accordion-pleated structure. The different rigid and flexible parts of the cup are made of polypropylene, the rigid parts being thicker.

The base 4 of the mouthpiece 2 is formed, at its lower portion (in the position shown in FIG. 2) by a part 8 comprised of two half-discs 8*a* and 8*b* of the same size, parallel to each other, and connected by a perpendicular wall 8*c*, the lower surface of which part 8 forms the assembling surface of the mouthpiece. Arranged under the half-disc 8*b* located at the highest level is a magnetized plate 9. Arranged under the periphery of the half-disc 8*a* is a skirt 8*d* in which has been internally made a groove 10. A shell 11 the wall of which is generally arranged according to a portion of a sphere and connected to the edge of part 8. This shell 11 is symmetrical with respect to the plane of the wall 8*c*. The shell 11 makes a tip 11*a* arranged in a diametrical plane of the cup passing through the end of the lip 5 and is connected, through a notch, to a lower point 11*s* arranged in the same diametrical plane as the tip 11*a*. A notch 12 made at the right side allows the user to seize the cup with one finger.

The lip 5 protrudes beyond the shell 11; its end 5*a* is provided with an opening and it is located on the longitudinal axis of the cup 1. The lip 5 is connected by bent surfaces to the edge of the shell 11, the lower surface connecting same to the lower portion of the shell being a concave film 5*b*. Arranged on the perpendicular wall 8*c* of part 8, in the vicinity of the periphery, is a small pipe 13 which protrudes perpendicularly to this wall. This pipe 13 forms one means of the device for the passage of the liquid from the refill into the mouthpiece. The pipe 13 is connected to a non-return valve 14 allowing the passage of the liquid only in the refill-mouthpiece direction. The non-return valve 14 is itself connected to a duct made of a flexible material 15 which ends into the opening 5*a* of the lip 5. Inserted at the end of the duct 15, in the vicinity of the opening 5*a* of the lip is a valve 16. This valve 16 is formed of two coaxial pipes: the inner pipe is closed at its end and is obliquely splitted in the vicinity of this end; the outer pipe is the duct 15 itself.

The cover of the refill 3 consists of a part 17 formed by two half-discs 17*a* and 17*b* of the same size located in parallel planes and connected by a perpendicular wall 17*c*, the lower surface of part 17 forming the assembling surface of the refill. In the wall 17*c* is made an opening 18 with a diameter such that the pipe 13 can enter into same. This opening is connected to a valve 19. The half-disc 17*a* is provided with a peripheral rim 20 capable of co-operating with the groove 10 made at the periphery of the base. Arranged at the periphery of part 17 is a cylindrical skirt 21 oriented downwards, the lower edge of which is located in a plane parallel to the half-discs 17*a* and 17*b*. Arranged in the portion of skirt 21 which is located at the periphery of the half-disc 17*b* is a feed valve 22; this valve 22 is located inside the skirt 21, at a point located on the radius of the half-disc 17*b* which is perpendicular to the wall 17*c*.

The receptacle 7 is arranged on the lower edge of the skirt 21; it has the shape of a truncated cone made of a flexible material having an accordion-pleated structure. When it is folded, it is almost flat (see FIG. 1), but it can elastically expand (see FIG. 2).

Figure 9:
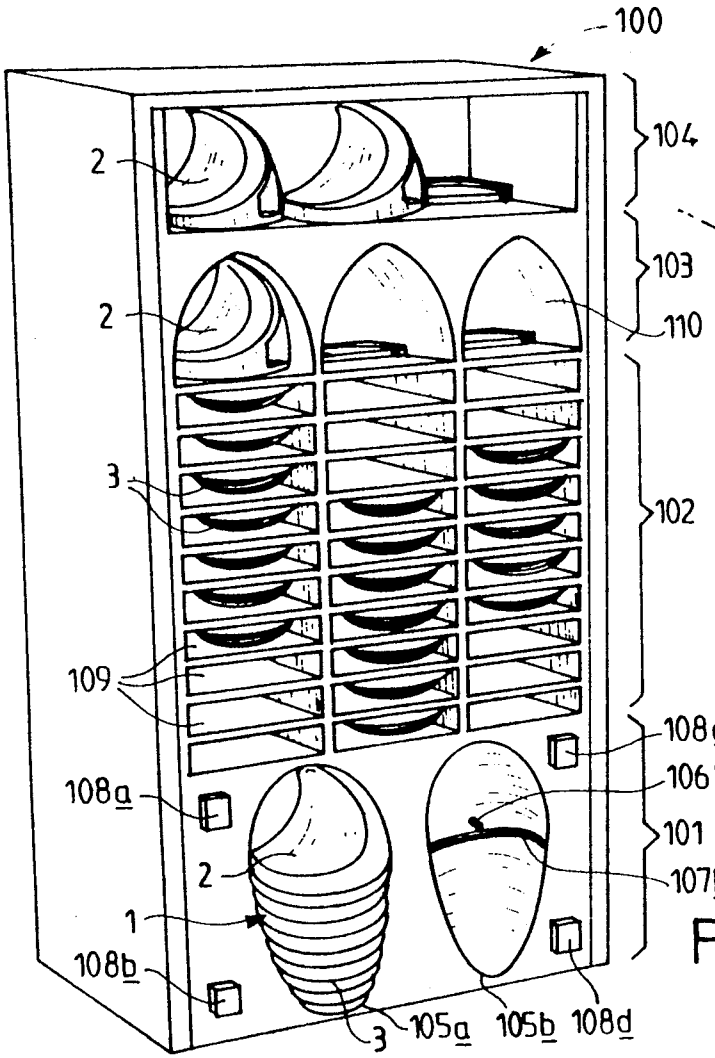
FIG. 9 is a perspective view of a cupboard serving for storing the refills and the mouthpieces, the washing of the mouthpieces and the filling of the cup.

FIG. 9 shows a combined cupboard according to the invention allowing to carry out, more particularly in the state of absence of gravity, on board a spacecraft, various operations related to the above-described cup. The combined cupboard is designated, in its whole, by reference numeral 100. This cupboard successively comprises four areas arranged above each other. The area 101 contains two tracks 105*a* and 105*b* for cold water and hot water, respectively. These tracks are advantageously coloured in blue for cold water and in red for hot water, respectively. The tracks 105*a* and 105*b* have a partial egg-shape corresponding to the shape of cup 1 upon injection of liquid. The track 105*b* includes a water-supply pipe 106*b*; likewise, the track 105*a* contains a water-supply pipe (which cannot be seen in FIG. 4). The pipe 106*b* is provided with a ring (not shown) which is itself connected to a non-return valve (not shown); this non-return valve opens into a pressurized hot-water tank. Similarly, the track 105*a* is put into communication with a pressurized cold-water tank.

As can be seen on track 105*b*, the track includes a rim 107*b* for positioning the cup. Arranged on the front panel of the filling area 101 are four buttons 108*a*, 108*b*, 108*c*, 108*d*. The buttons 108*a* and 108*c* control the cold-water and hot-water supply, respectively; the buttons 108*b* and 108*d* control the supply of 10 cl and 20 cl water, respectively; these buttons are connected to electric control devices for the supply and the metering of the quantity of liquid supplied. The buttons 108*b* and 108*d* include signal lamps which go out when the supply is completed.

The refill-storage area 102 located above the area 101 consists, according to the embodiment shown, of three vertical rows of trays 109.

The area 103 includes three ogivally shaped trays 110 arranged above the three rows of trays of the area 102; these trays allow the storage of three mouthpieces. The bottom of each of these three trays 110 has a shape complementary to that of the assembling surface of the mouthpiece and includes an opening for the introduction of the pipe 13 of the mouthpiece.

Figure 10:
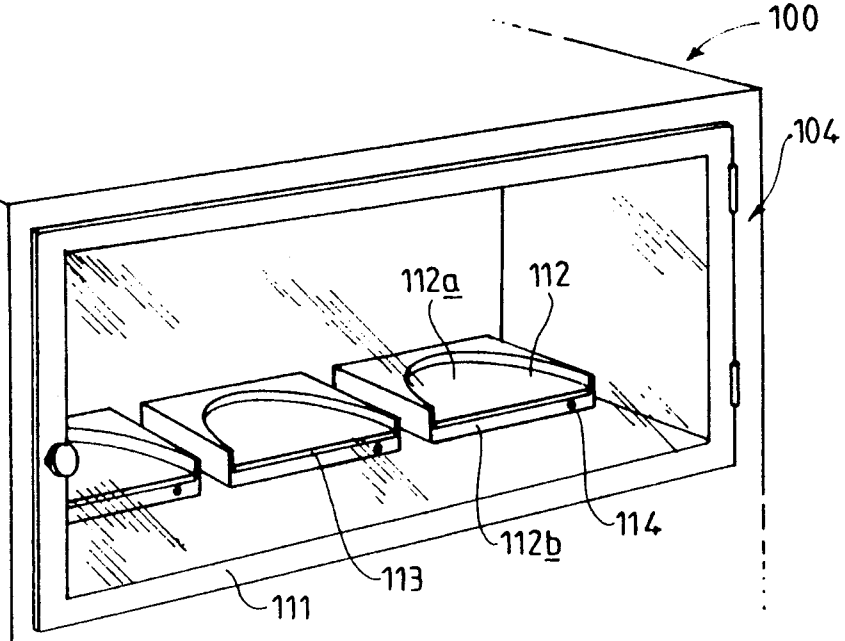
FIG. 10 is a perspective view of the washing area of the cupboard of FIG. 9.

The area 104 is the mouthpiece-washing area; it is closed by a door 111 shown in FIG. 10. The bottom of this area 104 is provided with three stands 112 each including a track 112*a* having, excepted the necessary backlash, the shape of the half-disc 8*b* of the mouthpiece 2 of the cup 1. This track 112*a* is covered with a magnet 113. The height of the front wall 112*b* of the stand (including the thickness of the magnet 113) is equal, excepted the necessary backlash, to the height of the vertical wall 8*c* of the mouthpiece 2. Each stand 112 is provided with a valve 114 capable of co-operating with the pipe 13 of the mouthpiece 2, when this latter is placed on the stand, in order to allow an injection and sucking-up of washing water into the mouthpiece. An injection and sucking-up of washing water are also provided inside the area 104 to allow a washing of the outer surface of the mouthpiece.

The use of the cup according to the invention is now described, for simplification's sake, in the case of a spationaut, in the state of absence of gravity. This use could obviously also be made by a user in the state of gravity, on earth.

When the spationaut wants a drink, he selects in the area 102 of the combined cupboard 100 the refill 3 corresponding to the beverage he wants. The area 102 contains, for instance, empty refills for the event the spationaut wants to drink water and refills of coffee without milk or with milk, with sugar or without sugar, chocolate with sugar or without sugar, tea with or without milk, with sugar or without sugar, or various fruit juices in the form of powder obtained by lyophilization. He takes a clean mouthpiece 2 out of the area 103 and assembles this mouthpiece 2 with the refill 3 selected. To carry out this assembling, he causes the half-disc 8*b* of the base to slide on the half-disc 17*b* of the cover and the half-disc 8*b* of the base on the half-disc 17*a* of the cover by bringing the opening 18 of the cover 6 in front of the small pipe 13 secured to the base, until the perpendicular wall 8*c* of the base is in contact with the perpendicular wall 17*c* of the cover; the rim 20 of the cover then completely rests in the groove 10 of the base. The pipe 13 passes through the opening 18 of the cover 6 and opens the valve 19.

When the cup 1 is thus assembled, the spationaut fills same. He introduces the cup 1 into a track 105*a* or 105*b*, according to whether he wants a hot or cold drink. The water-supply pipe 106 sinks into the valve 22 for the feeding of water into the cup 1; the skirt 21 of the cup pushes downwards the protection ring while releasing the pipe 106 and opening the associated non-return valve. This operation avoids the problems related to the lack of accuracy, since the filling can occur only when the pipe 106 is completely released from the ring and is, therefore, inside the valve 22. The spationaut then presses the button 108*a* or 108*c*, according to whether he wants cold or hot water and the button 108*b* or 108*d*, according to whether he wants 10 cl or 20 cl of beverage. The filling of the refill 3 starts, which causes the unfolding and the expansion of the receptacle 7. Since this latter has a flexibility due to the material it is made of and a structural flexibility, it has a tendency to recover its initial shape and to expel the beverage towards the upper portion of the refill 3, until it reaches the pipe 13. The beverage then causes the opening of the non-return valve 14 and can rise until the lip 5.

When the spationaut is drinking, he takes the cup by placing the finger in the notch 12, then takes the flexible lip 5 in his mouth and pinches said lip 5 with his lips or his teeth. He thus causes the valve 16 to open and the beverage flows into his mouth without having to suck or to press the receptacle 7 with his hands.

When the spationaut has finished drinking, he separates the mouthpiece 2 from the refill 3. He thus releases the pipe 13 from the valve 19 which closes and from the opening 18. The pipe 13 being released, the non-return valve 14 is no longer subjected to a differential pressure and closes. In these circumstances, the refill 3 and the mouthpiece 2 are closed and the liquid they may contain cannot spill. The spationaut then throws away the refill 3 and introduces the mouthpiece 2 into the washing area 104 of the combined cupboard 100. The spationaut arranges the mouthpiece 2 on the stand 112, the magnet 9 of the mouthpiece fixing itself onto the magnet 113. It simultaneously pushes the pipe 13 of the mouthpiece into the valve 114. He closes the door 111 and starts the device for washing the inside of the mouthpiece 2 and the device for washing the outside of the mouthpiece 2.

The device for washing the inside of the mouthpiece allows to carry out an injection of water through the valve 114 and a sucking for draining the washing-up water. The device for washing the outside of the mouthpiece 2 operates like a common washing-machine.

When the washing is completed, the spationaut stores the mouthpiece 2 in one of the trays 110 of the area 103 of the combined cupboard 100.

I claim:

1. A storage compartment for cups of the type having a mouthpiece and a receptacle with said mouthpiece being attachable to said receptacle for use, said mouthpiece including a closed enclosure including a lip and a base provided with a first passage means extending from said base to said lip, said lip being made of a flexible material, said receptacle including a cover having a non-return valve for filling said receptacle, said receptacle having a wall expandable under pressure of a fluid received into said receptacle, said storage compartment having a filling area including at least one water tank and at least one track for the filling of a said cup and a device cooperating with said non-return valve for feeding liquid into said receptacle; and a washing area for at least one mouthpiece including means for washing the interior of a said mouthpiece and means for washing the exterior of a said mouthpiece.

2. The storage compartment as claimed in claim 1 wherein said compartment includes an area including trays for storing receptacles.

3. The storage compartment as claimed in claim 1 wherein an area is provided for storing at least one mouthpiece.

4. The storage compartment as claimed in claim 1 wherein said filling area includes two tanks and two tracks, one of said tanks being provided for cold water and communicating with a first track and a second tank being provided for hot water and being associated with said second track.

5. The storage compartment as claimed in claim 4 wherein a said cup is expandible to achieve an egg-shape and each said track has a partial egg-shape corresponding to the shape of a said cup upon expansion of a said receptacle.

6. The storage compartment as claimed in claim 1 wherein said device cooperating with said non-return valve for feeding liquid into said receptacle comprises a pipe provided with a protection ring and said non-return valve being structured so that pressure on said protection ring causes said non-return valve to open.

7. The storage compartment as claimed in claim 1 wherein said filling area includes metering means for metering the quantity of liquid supplied to a said receptacle.

8. The storage compartment as claimed in claim 1 wherein said washing area includes at least one washing position having a shape complementary to that of the surface of said base of said mouthpiece and a device cooperating with means for the passage of liquid into the mouthpiece to inject a washing liquid into said mouthpiece and to apply suction to same upon completion of the washing cycle.

9. The storage compartment as claimed in claim 8 wherein said position includes magnetic means cooperating with a corresponding magnet provided in the mouthpiece for securing the mouthpiece thereon.

10. The storage compartment as claimed in claim 1 wherein said washing area is provided with a door for tightly closing said washing area.

11. The storage compartment as claimed in claim 3 wherein each said mouthpiece has an assembling surface and said area for storing said mouthpieces includes at least one tray having a bottom shape complementary to that of said assembling surface.

12. A cup provided with a flexible lip capable of being taken in the mouth by a user, said lip including an outlet and a duct having a first end connected to said outlet and a second end remote from said first end, said cup including a receptacle adapted to contain a liquid, said receptacle including a wall of flexible material so as to expand when a liquid is injected into said receptacle and to exert on the liquid a pressure tending to expel the liquid from the receptacle, said duct having at said first end a flexible valve that is moved from a closed condition to an open position by pinching said lip, said wall having an accordion-pleated shape, said lip including a mouthpiece having a rigid base, said receptacle being refillable and attachable to said base of said mouthpiece during use, said mouthpiece comprising an enclosure including said rigid base, said enclosure having grasping means for a user and first passage means for conveying the liquid from the receptacle into said mouthpiece, a first means for securing said receptacle to said mouthpiece, said lip being integral with said base; said receptacle comprising a closed structure including a cover having a second passage means for conveying the liquid from said receptacle to said first passage means, a second means for cooperating with said first means of said mouthpiece to secure said receptacle to said mouthpiece, said cover including a non-return valve for feeding the liquid into said receptacle.

13. The cup as claimed in claim 12 wherein said first end of said duct includes a flexible valve, said flexible valve comprising two coaxial, flexible pipes with the inner one of said pipes being closed at said first end of said duct, said first end including a slit in a plane which is oblique with respect to the axis of said pipes.

14. The cup as claimed in claim 12 wherein said base includes two equal half-discs located in two parallel planes spaced from each other, said half-discs being connected to each other along an edge by a wall located along the diameters of each said half-disk which delimit said half-discs in a plane perpendicular to their plane and by a shell connected to the periphery of said half-discs, said shell forming the base of said half-discs, said shell having an edge forming a tip adjacent said outlet, said shell having said grasping means thereon.

15. The cup as claimed in claim 14 wherein said lip is made of a flexible material including said tip with said tip being bent towards the axis of said cup and having a portion connected to said shell by means of a concavely shaped film made of flexible material, said shell having the shape of a portion of a sphere.

16. The cup as claimed in claim 12 wherein said duct is made of flexible material connecting said flexible valve to said first passage means.

17. The cup as claimed in claim 12 wherein said cover of said receptacle includes two equally parallel extending half-discs connected to each other alongside the diameters of said half-discs by a wall which is perpendicular to each of said half-discs, said half-discs having a periphery with a peripheral wall connected to said periphery and onto which is secured said receptacle.

18. The cup as claimed in claim 17 wherein said second passage means for conveying the liquid from said receptacle to said first passage means is carried by said perpendicular wall extending between said half-discs.

19. The cup as claimed in claim 18 wherein said second passage means comprises a pipe extending perpendicularly to said perpendicular wall and passing through said wall.

20. The cup as claimed in claim 12 wherein said second passage means includes a one-way valve, said base of said mouthpiece including a member for opening said one-way valve of said second passage means when said cover is attached to said mouthpiece.

21. Cup according to claim 12, characterized in that the receptacle (7) is non-removably secured onto the mouthpiece.

* * * * *